US007010942B2

(12) United States Patent
Ryu et al.

(10) Patent No.: US 7,010,942 B2
(45) Date of Patent: Mar. 14, 2006

(54) DRUM TYPE WASHING MACHINE

(75) Inventors: Doo-Young Ryu, Suwon (KR); Koan-Seog Namkung, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 337 days.

(21) Appl. No.: 10/223,613

(22) Filed: Aug. 20, 2002

(65) Prior Publication Data

US 2003/0061843 A1 Apr. 3, 2003

(30) Foreign Application Priority Data

Sep. 28, 2001 (KR) ..... 2001-60365

(51) Int. Cl.
*D06F 37/04* (2006.01)

(52) U.S. Cl. ..... 68/19; 68/19.2; 68/142; 34/108; 34/130

(58) Field of Classification Search ..... 68/18 R, 68/207, 13 R, 19, 19.2, 142; 34/108, 130
See application file for complete search history.

(56) References Cited

U.S. PATENT DOCUMENTS

| | | | | | |
|---|---|---|---|---|---|
| 57,075 | A | * | 8/1866 | Bisbee | 68/142 |
| 318,413 | A | * | 5/1885 | Burkhardt | 68/16 |
| 382,149 | A | * | 5/1888 | Fowles | 68/142 |
| 550,672 | A | * | 12/1895 | Jones | 68/142 |
| 947,611 | A | * | 1/1910 | Baker | 68/142 |
| 1,097,510 | A | * | 5/1914 | English | 68/142 |
| 1,102,268 | A | * | 7/1914 | Bartholomew | 68/142 |
| 1,295,421 | A | * | 2/1919 | Holliday | 68/142 |
| 1,358,168 | A | * | 11/1920 | McCutchen | 68/58 |
| 1,631,266 | A | * | 6/1927 | Hasha | 68/58 |
| 1,697,861 | A | * | 1/1929 | Garfield | 68/25 |
| 2,062,286 | A | * | 12/1936 | Emil | 68/151 |
| 2,101,841 | A | * | 12/1937 | Dinley | 202/170 |
| 2,434,476 | A | * | 1/1948 | Wales | 68/19.2 |
| 2,436,343 | A | * | 2/1948 | Wilson | 68/25 |
| 2,543,993 | A | * | 3/1951 | Stanitz et al. | 134/141 |
| 2,559,708 | A | * | 7/1951 | Calhoun | 68/25 |
| 2,574,798 | A | * | 11/1951 | Christian | 68/4 |
| 2,575,335 | A | * | 11/1951 | Douglas | 68/17 R |
| 2,584,070 | A | * | 1/1952 | Walker | 68/58 |

(Continued)

FOREIGN PATENT DOCUMENTS

DE 30 12 933 * 10/1980

(Continued)

OTHER PUBLICATIONS

Europena Patent Office 0 087 649 2-1983.*

*Primary Examiner*—Frankie L. Stinson
(74) *Attorney, Agent, or Firm*—Staas & Halsey LLP

(57) ABSTRACT

A drum type washing machine includes a cabinet which defines an outer appearance of the washing machine, a water tub set inside the cabinet to contain wash water therein, a rotary tub having spin drying perforations and rotatably set in the water tub, and a water turbine which is mounted at an open front of the rotary tub and rotates along with the rotary tub to spray the wash water contained in the water tub into the rotary tub. The water turbine includes an external member having an annular shape, and an internal member having an annular shape corresponding to the external member. The internal member is arranged apart from the external member by a predetermined interval. A vane unit is set between the external and the internal members, and raises the wash water contained in the water tub and sprays the wash water into the rotary tub.

27 Claims, 11 Drawing Sheets

U.S. PATENT DOCUMENTS 2,774,148 A * 12/1956 Worth ..... 34/601
2,816,429 A * 12/1957 Kurlancheek ..... 68/19.2
2,818,659 A * 1/1958 Hague ..... 34/139
3,277,583 A * 10/1966 Mack ..... 34/58
3,448,596 A * 6/1969 Bochan ..... 68/18 F
4,809,524 A * 3/1989 Sickert et al. ..... 68/148
4,888,965 A * 12/1989 Fanson et al. ..... 68/23.4
5,617,747 A * 4/1997 Kim ..... 68/53
5,865,046 A * 2/1999 Na et al. ..... 68/23.6
5,878,601 A * 3/1999 Won et al. ..... 68/23.5
6,145,350 A * 11/2000 Hwang ..... 68/18 F
6,167,733 B1 1/2001 Lee
6,241,781 B1 * 6/2001 Han ..... 8/159
6,247,339 B1 * 6/2001 Kenjo et al. ..... 68/12.04
6,351,974 B1 * 3/2002 Lyu et al. ..... 68/148

FOREIGN PATENT DOCUMENTS

JP 8-103593 * 4/1996

* cited by examiner

DRUM TYPE WASHING MACHINE

CROSS-REFERENCE TO RELATED APPLICATIONS

This application claims the benefit of Korean Patent Application No. 2001-60365 filed on Sep. 28, 2001, in the Korean Industrial Property Office, the disclosure of which is incorporated herein by reference.

BACKGROUND OF THE INVENTION

1. Field of the Invention

The present invention relates to a washing machine, and more particularly, to a drum type washing machine having a water turbine at a front of a rotary tub, so as to raise wash water with detergent and spray the mixture on laundry in a washing operation.

2. Description of the Related Art

Generally, washing machines are used to wash laundry by rotating a cylindrical rotary tub containing the laundry and wash water therein. Such washing machines have been typically classified into drum type washing machines and vertical shaft type washing machines. The drum type washing machines are designed such that a rotary tub is horizontally set in a cabinet and is rotated around a horizontal axis of the cabinet in opposite directions to repeatedly move the laundry seated on an internal surface of the rotary tub upward and allow the laundry to be dropped from the top to the bottom inside of the rotary tub to wash the laundry. In the vertical shaft type washing machines, a rotary tub with a pulsator is vertically set in a cabinet and is rotated around a vertical axis of the cabinet in opposite directions. In vertical shaft type washing machines, laundry inside the rotary tub are washed by forced water currents generated by the pulsator.

FIG. 1 shows the internal structure of a conventional drum type washing machine ("washing machine"). The washing machine includes a cabinet 1 which defines an outer appearance of the washing machine. A cylindrical water tub 2 is horizontally set in the cabinet 1, and receives wash water therein. A rotary tub 3 having a cylinder shape drum is rotatably set in the cylindrical water tub 2, and is perforated on its sidewall to have spin-drying perforations 3*a*. The drum type washing machine also has a drive motor 4 which rotates the rotary tub 3.

The cabinet 1 has an opening to allow a user to place the laundry in the rotary tub 3 or remove the laundry from the rotary tub 3. A front door 5 is hinged to the opening of the cabinet 1 to selectively close the rotary tub 3. Lifters 6 are positioned on an internal surface of the rotary tub 3 at regular intervals. In response to rotating of the rotary tub 3, the lifters 6 repeatedly move the laundry seated on the internal surface of the rotary tub 3 upward and drop the laundry from the top to the bottom inside of the rotary tub 3 to wash the laundry.

The cabinet 1 is provided at its upper portion with a water supply hose 7 and a detergent container 8. A circulation pump 9 and a drain pump 10 are provided at a bottom of the cabinet 1.

Unlike the vertical shaft type washing machines with a rotary tub vertically set in a cabinet, which wash laundry inside the rotary tub with forced water currents generated by a pulsator, the drum type washing machines consume a small quantity of water. However, the drum type washing machines take a longer time to wash the laundry due to a washing method used, that is, lifting and dropping of the laundry. In the drum type washing machines, detergent is also not rapidly dissolved in wash water and undesirably lays thick on a bottom of a water tub.

To solve the above problem, the circulation pump 9 is installed in the drum type washing machine shown in FIG. 1. In other words, the circulation pump 9 is used to move the detergent accumulated on the bottom of the cylindrical water tub 2 upward, which is not dissolved in the wash water, together with the wash water to rapidly dissolve the detergent in the wash water and wet the laundry.

A wash operation of the conventional drum type washing machine described above is as follows. First, wash water with detergent is fed to the cylindrical water tub 2 through the water supply hose 7 and the detergent container 8. At this time, the wash water having the detergent is supplied into the rotary tub 3, which contains the laundry therein, through the perforations 3*a* formed on the sidewall of the rotary tub 3 until a predetermined wash water height is achieved. Next, the rotary tub 3 is repeatedly rotated in alternating directions at regular intervals by the drive motor 4. When the rotary tub 3 is rotated, the lifters 6 provided on the internal surface of the rotary tub 3 move the laundry upward and allow the laundry to be dropped from a height inside the tub 3 to wash the laundry. At the same time, the circulation pump 9 is actuated to raise the wash water with the detergent from the bottom to the top of the cylindrical water tub 2 through a circulation hose 11 connected to an inlet and outlet of the circulation pump 9 and upper and lower ends of the cylindrical water tub 2, and discharge the wash water from the top of the cylindrical water tub 2 to wet the laundry.

After a washing operation is completed in a set period of time, the drain pump 10 is actuated to discharge the wash water to the outside through a drain hose 12. Thereafter, the washing machine performs a rinsing operation to remove the detergent from the laundry. Finally, the drive motor 4 rotates the rotary tub 3 at a high speed while actuating the drain pump 10 to spin-dry the laundry, thus completing the wash operation.

However, in the conventional drum type washing machine, only a small portion of the wash water with detergent is raised from the bottom to the top inside of the cylindrical water tub 2 and discharged to the rotary tub 3 by the circulation pump 9 and the circulation hose 11 during the washing operation. That is, only a part of the wash water flows into the rotary tub 3 through the perforations 3*a* during the rotation of the rotary tub 3, and the remaining wash water flows down to the bottom of the cylindrical water tub 2 along the external surface of the rotary tub 3. Accordingly, the conventional drum type washing machine is incapable of sufficiently wetting the laundry. Therefore, additional time is required to properly wet the laundry, further extending the time required to wash the laundry.

Furthermore, with use of the circulation pump 9 and the circulation hose 11 to wet the laundry, manufacturing cost is increased. Also, operational noise as well as vibration are increased by the operation of the circulation pump 9. Such noise and vibration give negative impressions to consumers as to the quality of the washing machine, and lower durability of components in the washing machine.

SUMMARY OF THE INVENTION

Accordingly, it is an object of the present invention to provide a drum type washing machine which rapidly dissolves detergent in wash water without an additional drive device.

Another object of the present invention is to provide a drum type washing machine which directly sprays forced water currents onto laundry, so as to rapidly wet the laundry and increase the washing effect of the washing machine.

Additional objects and advantages of the invention will be set forth in part in the description which follows and, in part, will be obvious from the description, or may be learned by practice of the invention.

To achieve the above and other objects of the present invention, there is provided a drum type washing machine comprising a cabinet which defines an outer appearance of the washing machine, a water tub set inside the cabinet to contain wash water therein, a rotary tub rotatably set in the water tub and includes spin-drying perforations, and a water turbine which is mounted at a surface of the rotary tub, rotates along with the rotary tub and sprays the wash water contained in the water tub into the rotary tub.

The water turbine comprises an external member having an annular shape, an internal member having an annular shape corresponding to the external member and arranged apart from the external member by an interval, and a vane unit which is set between the external and the internal members, raises the wash water contained in the water tub and sprays the wash water into the rotary tub.

According to an aspect of the present invention, the vane unit comprises a partition plate which is positioned between the external and internal members and forms external and internal chambers, internal vanes provided on a first surface of the partition plate at first predetermined intervals, and external vanes provided on a second surface of the partition plate at second predetermined intervals, wherein the external and internal vanes are curved in opposite directions so as to raise the wash water regardless of a rotating direction of the rotary tub.

The internal member includes a flat surface part having a set length, and an inclined surface part which extends from the flat surface part toward an inner circumferential edge of the external member. The partition plate includes a flat surface part and an inclined surface part which correspond to the flat surface part and the inclined surface part of the internal member. The inclined surface part of the internal member and the inner circumferential edge of the external member form an injection nozzle therebetween having a set width, and an end portion of the inclined surface part of the partition plate is placed adjacent to the injection nozzle.

Each of the internal vanes set in the internal chamber comprises a guide part which connects the outer circumferential edge of the internal member to the outer circumferential edge of the partition plate, and a vane part which extends from an end of the guide part and is mounted at the inclined surface part of the internal member so as to be curved in a direction, wherein internal wash water inlets are formed between the guide parts of the internal vanes. Each of the external vanes set in the external chamber comprises a guide part which connects the outer circumferential edge of the external member to the outer circumferential edge of the partition plate, and a vane part which extends from an end of the guide part and is mounted at the inclined surface part of the partition plate so as to be curved in the opposite direction with respect to the vane part of each of the internal vanes, wherein external wash water inlets are formed between the guide parts of the external vanes. The vane parts of the external and internal vanes move the wash water upward as the rotary tub is rotated in alternating directions.

The external member includes an injection guide part which extends from the inner circumferential edge of the external member toward the inclined surface part of the internal member by a predetermined length, and guides the wash water passing through the injection nozzle into the rotary tub.

According to another aspect of the present invention, the internal member includes a flat surface part having a set length and an inclined surface part which extends from the flat surface part toward an inner circumferential edge of the external member, wherein the inclined surface part of the internal member and the inner circumferential edge of the external member form an injection nozzle therebetween having a set width.

The vane unit comprises guide parts which connect corresponding outer circumferential edges of the external and internal members, wherein wash water inlets are formed between the guide parts arranged in predetermined intervals, and vanes which inwardly extend from the corresponding guide plates, wherein a first edge of each of the vanes is connected to the flat surface part and the inclined surface part of the internal member, and a second edge of each of the vanes is connected to an internal surface of the external member.

The external member includes an injection guide part which extends from the inner circumferential edge of the external member toward the inclined surface part of the internal member by a predetermined length, and guides the wash water passing through the injection nozzle into the rotary tub.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
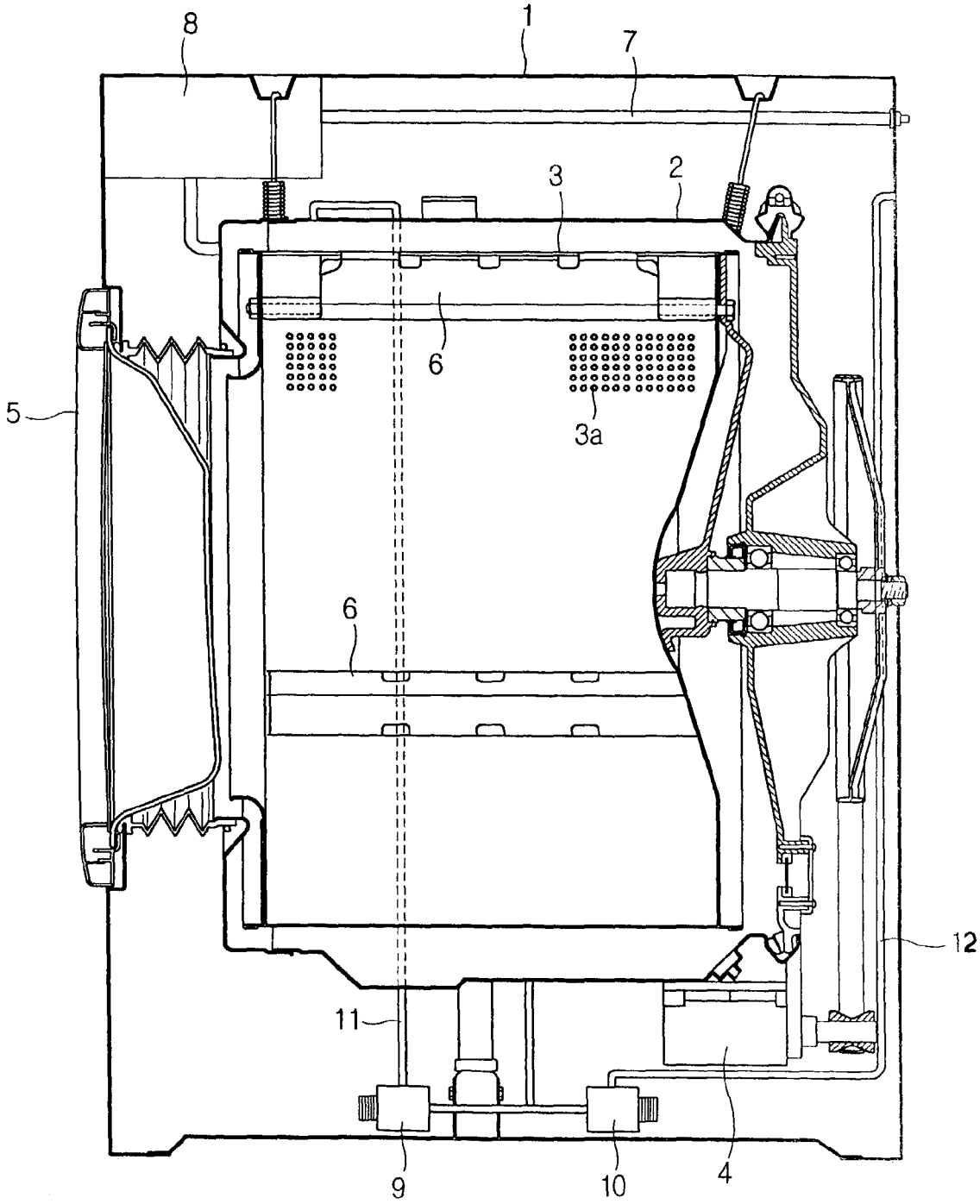
FIG. 1 (Prior Art)
FIG. 1 is a sectional view showing the internal structure of a conventional drum type washing machine.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
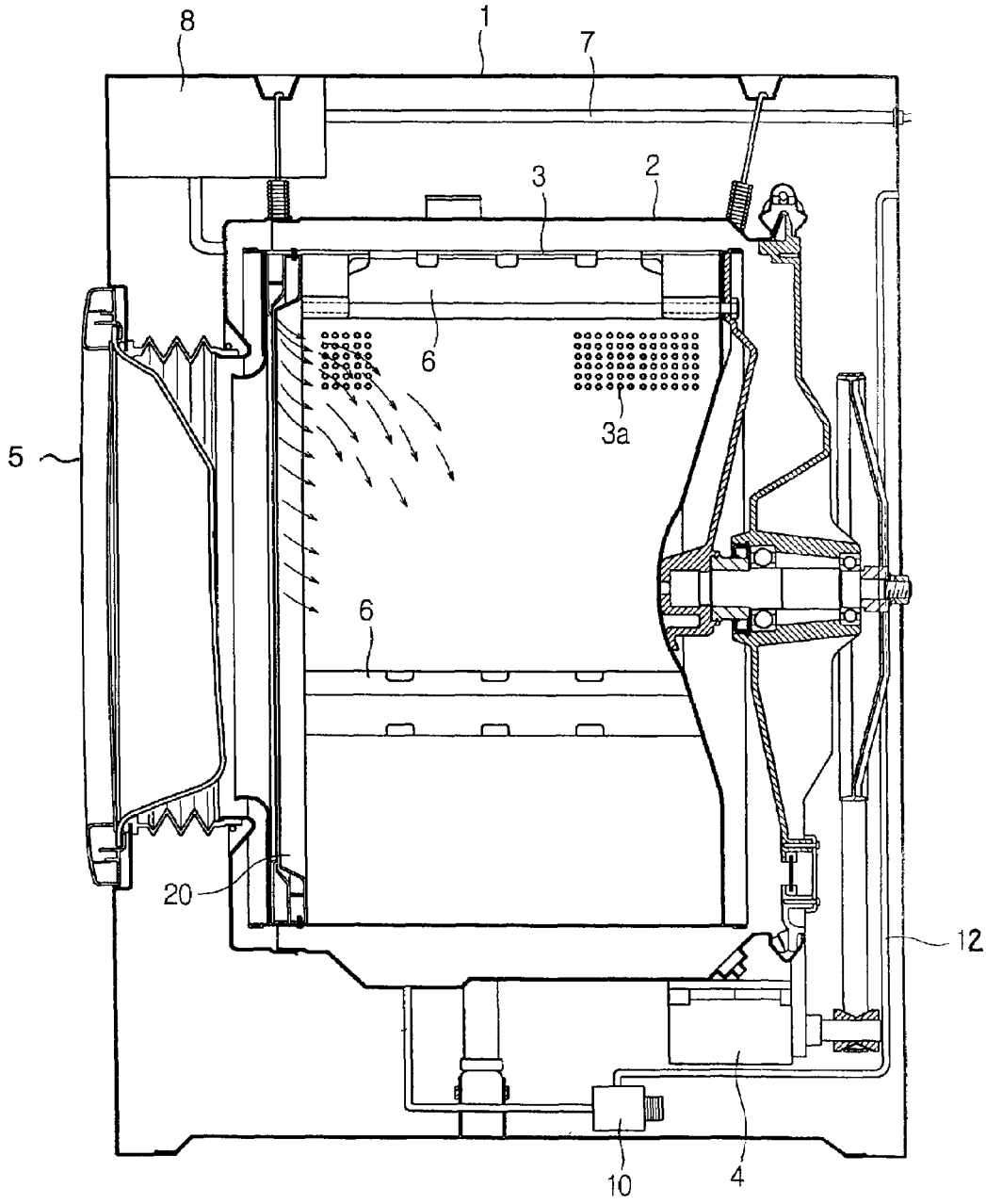
FIG. 2 is a sectional view of the internal structure of a drum type washing machine having a water turbine according to an embodiment of the present invention.

FIG. 2 shows a drum type washing machine having a water turbine 20 mounted at a surface of a rotary tub 3 adjacent to a front door 5. The water turbine 20 effectively performs the function of pumping wash water without requiring a circulation pump 9 or a circulation hose 11 included in the conventional drum type washing machine of FIG. 1. The water turbine 20 is fitted in an end of the rotary tub 3 and may be attached thereto using screws as shown, or an adhesive.

Where the rotary tub 3 is rotated clockwise or counterclockwise by a drive motor 4 in a washing operation, the water turbine 20 is rotated along with the rotary tub 3 without an additional drive force, and the wash water with detergent contained in a water tub 2 is raised and sprayed into the rotary tub 3. The water turbine 20 rapidly wets the laundry and allows the laundry to be effectively washed by a spraying force of the wash water. The construction and an operation of the water turbine 20 will be described in detail below.

Figure 3:
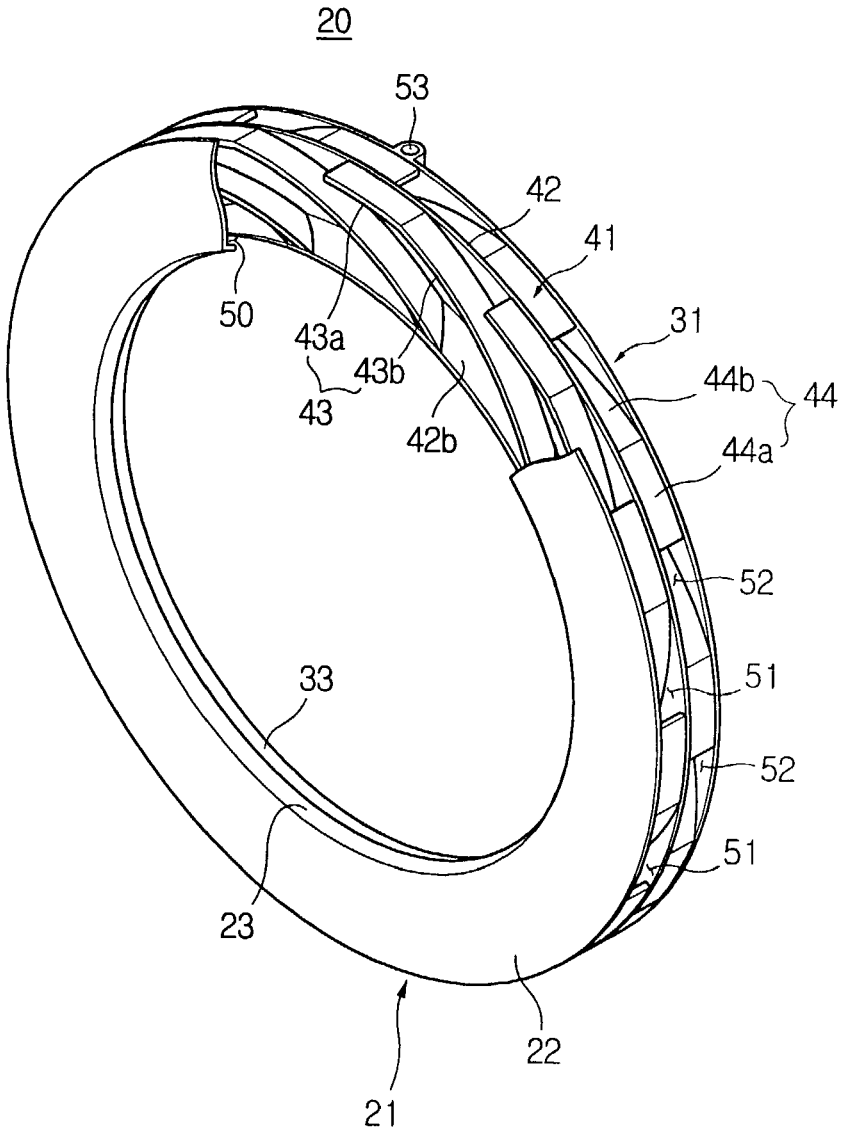
FIG. 3 is a partial cutaway perspective view of the water turbine of the drum type washing machine shown in FIG. 2.
Figure 4:
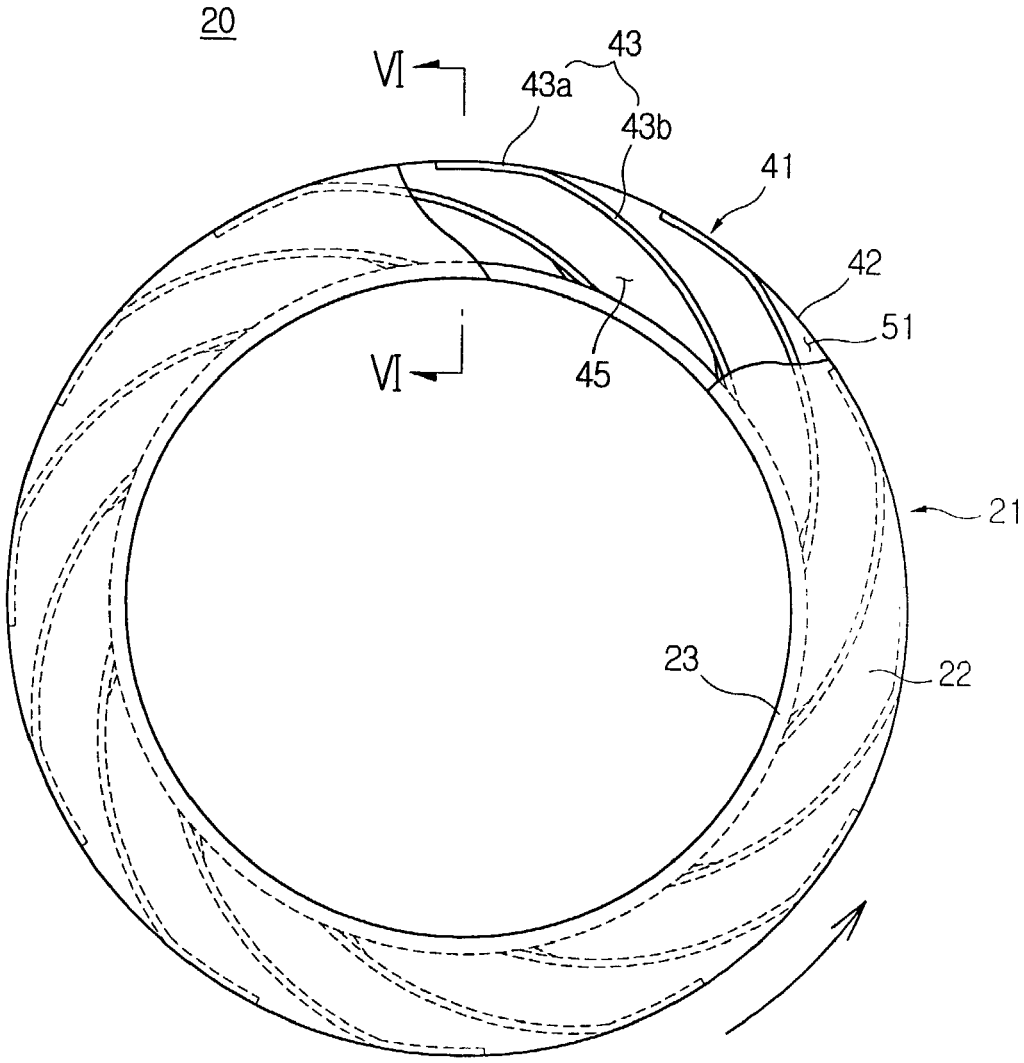
FIG. 4 is a partial cutaway right side view of the water turbine of FIG. 3.
Figure 5:
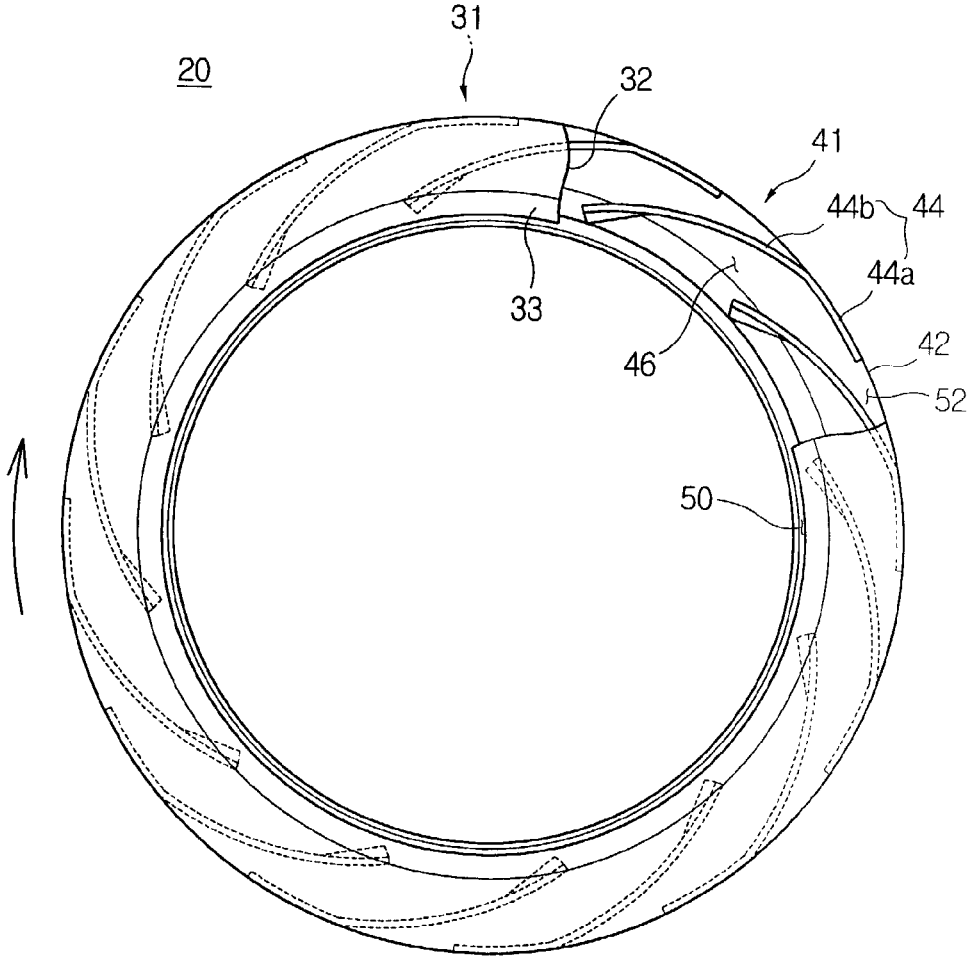
FIG. 5 is a partial cutaway left side view of the water turbine of FIG. 3.
Figure 6:
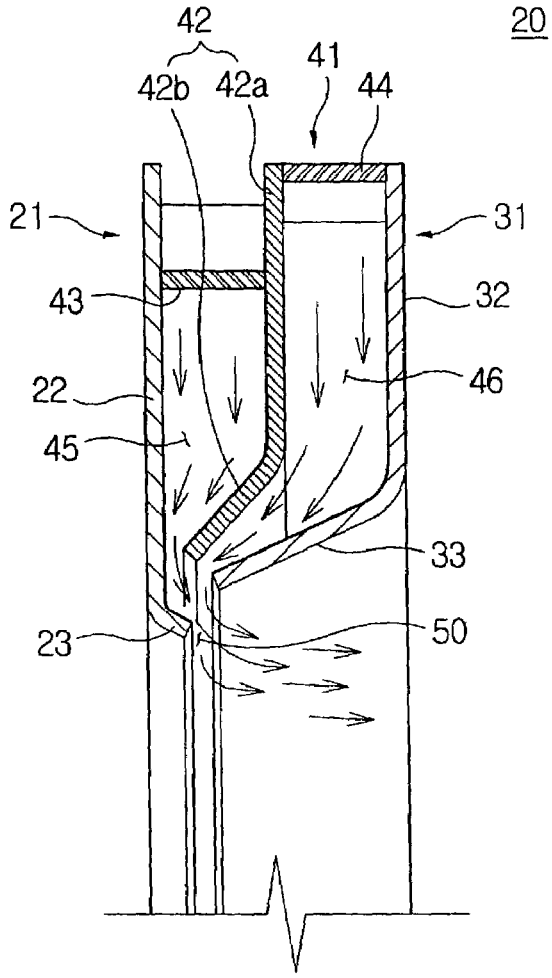
FIG. 6 is a sectional view taken along the line VI—VI of FIG. 4.

FIGS. 3–6 show the water turbine 20 according to an embodiment of the present invention. FIG. 3 shows a partial cutaway perspective view of the water turbine 20. FIGS. 4 and 5 show a partial cutaway right side view and a partial cutaway left side view of the water turbine 20, respectively. FIG. 6 shows a sectional view taken along the line VI—VI of FIG. 4.

As shown in FIGS. 3–6, the water turbine 20 comprises an external member 21 and an internal member 31 which are positioned so as to be opposite to each other. The water turbine 20 further includes a vane unit 41 set between the external and internal members 21 and 31. In this case, the external member 21 is placed adjacent to the front door 5 while the internal member 31 is placed adjacent to the inside of the rotary tub 3.

The external and internal members 21 and 31 have annular shapes, and are spaced apart from each other by a predetermined interval. Wash water inlets 51 and 52 are formed along the outer circumferences of the external and internal members 21 and 31, respectively, so as to have the wash water flow into the vane unit 41 through the wash water inlets 51 and 52.

As shown in FIG. 6, the internal member 31 includes a flat surface part 32 having a predetermined vertical length, and an inclined surface part 33 which extends from the flat surface part 32 toward the inner circumferential edge of the external member 21. The external member 21 includes a flat surface part 22 and an injection guide part 23. In this case, the vertical length of the flat surface part 22 is almost equal to the vertical length obtained by adding the vertical length of the flat surface part 32 to that of the inclined surface part 33 of the internal member 31. The injection guide part 23 forms an end of the flat surface part 22 of the external member 21. That is, the injection guide part 23 extends from the inner circumferential edge of external member 21 beyond a terminal edge of the inclined surface part 33 of the internal member 31.

An annular injection nozzle ("injection nozzle") 50 of a predetermined width is formed between the inner circumferential edges of the external and internal members 21 and 31. The wash water passing through the injection nozzle 50 is guided into the rotary tub 3 containing the laundry therein by the injection guide part 23 (see arrows in FIG. 2).

The vane unit 41 is set between the external and the internal members 21 and 31, and includes a partition plate 42, and a plurality of external and internal vanes 43 and 44. In this case, the partition plate 42 separates the external member 21 from the internal member 31. The external and internal vanes 43 and 44 are provided on corresponding side surfaces of the partition plate 42, at regular intervals. Thus, two chambers, that is, an external chamber 45 and an internal chamber 46 are formed between the external and internal members 21 and 31 by the partition plate 42. The external vanes 43 are set in the external chamber 45, while the internal vanes 44 are set in the internal chamber 46.

The partition plate 42 is used to prevent the wash water flowing into either of the two chambers 45 and 46 from flowing into the other chamber, and rapidly guides the wash water flowing into one of the chamber 45 and 46 into the injection nozzle 50. To carry out such functions, as shown in FIG. 6, the partition plate 42 includes a flat surface part 42*a* and an inclined surface part 42*b*. In this case, the flat surface part 42*a* separates the external member 21 from the internal member 31. The inclined surface part 42*b* extends from the flat surface part 42*a*, and is arranged so as to have its edge adjacent to the injection nozzle 50 and guide the wash water flowing into one of the two chambers 45 and 46 into the injection nozzle 50.

The external vanes 43 are set in a space defined by one side surface of the partition plate 42 and an inner surface of the external member 21, while the internal vanes 44 are set in a space defined by the other side surface of the partition plate 42 and an inner surface of the internal member 31. That is, as shown in FIGS. 3 and 4, each of the external vanes 43 includes a guide part 43*a* and a vane part 43*b*. The guide part 43*a* is formed by connecting the outer circumferential edge of the external member 21 to that of the partition plate 42. The vane part 43*b* extends inwardly from one end of the guide part 43*a* while forming a curved surface. The inside end of the vane part 43*b* is mounted at the inclined surface part 42*b* of the partition plate 42. In this case, a plurality of external vanes 43 are set in the external chamber 45 so as to be spaced apart from each other by a predetermined interval, and form the wash water inlets 51 between the guide parts 43*a* of the external vanes 43. The wash water inlets 51 channel the wash water into the external chamber 45. As the rotary tub 3 is rotated counterclockwise, as shown by an arrow in FIG. 4, the wash water flows into the wash water inlets 51 and moves along the vane parts 43*b*.

As shown in FIGS. 3 and 5, each of the internal vanes 44 includes a guide part 44*a* and a vane part 44*b*. The guide part 44*a* is formed by connecting the outer circumferential edge of the internal member 31 to that of the partition plate 42. The vane part 44*b* extends inwardly from one end of the guide part 44*a* in a direction opposite to that of the vane parts 43*b* of the external vanes 43 while forming a curved surface. The inside end of the vane part 44*b* is mounted at the inclined surface part 33 of the internal member 31. In this case, the internal vanes 44 are set in the internal chamber 46 so as to be spaced apart from each other by a predetermined interval, and form the wash water inlets 52 between the guide parts 44*a* of the internal vanes 44. The wash water inlets 52 channel the wash water into the internal chamber 46. As the rotary tub 3 is rotated clockwise, as shown by an arrow in FIG. 5, the wash water flows into the wash water inlets 52 and moves along the vane parts 44*b*.

As described above, the water turbine 20 according to the present invention includes the external member 21, the internal member 31, the vane unit 41 set between the external and internal chambers 45 and 46, the wash water inlets 51 and 52 formed along the outer circumferences of the external and internal members 21 and 31, and the injection nozzle 50 formed between the inclined surface part 33 of the internal member 31 and the inner circumferential edge of the external member 21, which are placed so as to be adjacent to each other. Furthermore, the external and internal vanes 43 and 44 are attached to corresponding side surfaces of the partition plate 42 of the vane unit 41, respectively. In this case, the external and internal vanes 43 and 44 are curved in opposite directions.

Such a water turbine 20, as shown in FIG. 3, has screw holes 53 at regular intervals, so as to be screwed to the rotary tub 3. The internal member 21, the external member 31 and the vane unit 41 are assembled into a single structure using an adhesive or screws.

Where the above water turbine 20 is rotated in a counterclockwise direction together with the rotary tub 3, the wash water flows to the external chamber 45 through the wash water inlets 51, and moves along the vane parts 43*b* of the external vanes 43. In such a case, the wash water is guided by the partition plate 42 and the external member 21 to the injection nozzle 50. While the wash water passes through the injection nozzle 50, the wash water is accelerated. Such accelerated wash water flows into the rotary tub 3 under the guide of the injection guide part 23 of the external member 21, thus beating the laundry while wetting the laundry. In response to rotating of the rotary tub 3 in the counterclockwise direction, the wash water continuously flows into the external chamber 45 by a plurality of external vanes 43 positioned at regular intervals, and passes through the injection nozzle 50. The wash water passing through the injection nozzle 50 forms an annular shape due to the shape of the injection nozzle 50, and generates continuous water currents to be sprayed into the rotary tub 3, thus rapidly wetting the laundry as well as increasing the washing effect.

On the other hand, as the rotary tub 3 is rotated in a clockwise direction, the water turbine 20 is also rotated in the clockwise direction. At this time, the wash water flows to the internal chamber 46 through the wash water inlets 52 and moves along the vane parts 44*b* of the internal vane 44. In such a case, the wash water is guided by the partition plate 42 and the internal member 31 so as to rapidly flow to the injection nozzle 50, and is sprayed into the rotary tub 3 under the guide of the injection guide part 23 of the external member 21.

The water turbine 20 is provided in its chambers 45 and 46 with the vanes 43 and 44 curved in opposite directions, respectively. Such a structure allows the wash water in the water tub 2 to be raised through the chambers 45 and 46, regardless of the rotating direction of the rotary tub 3, and be sprayed into the rotary tub 3.

Figure 7:
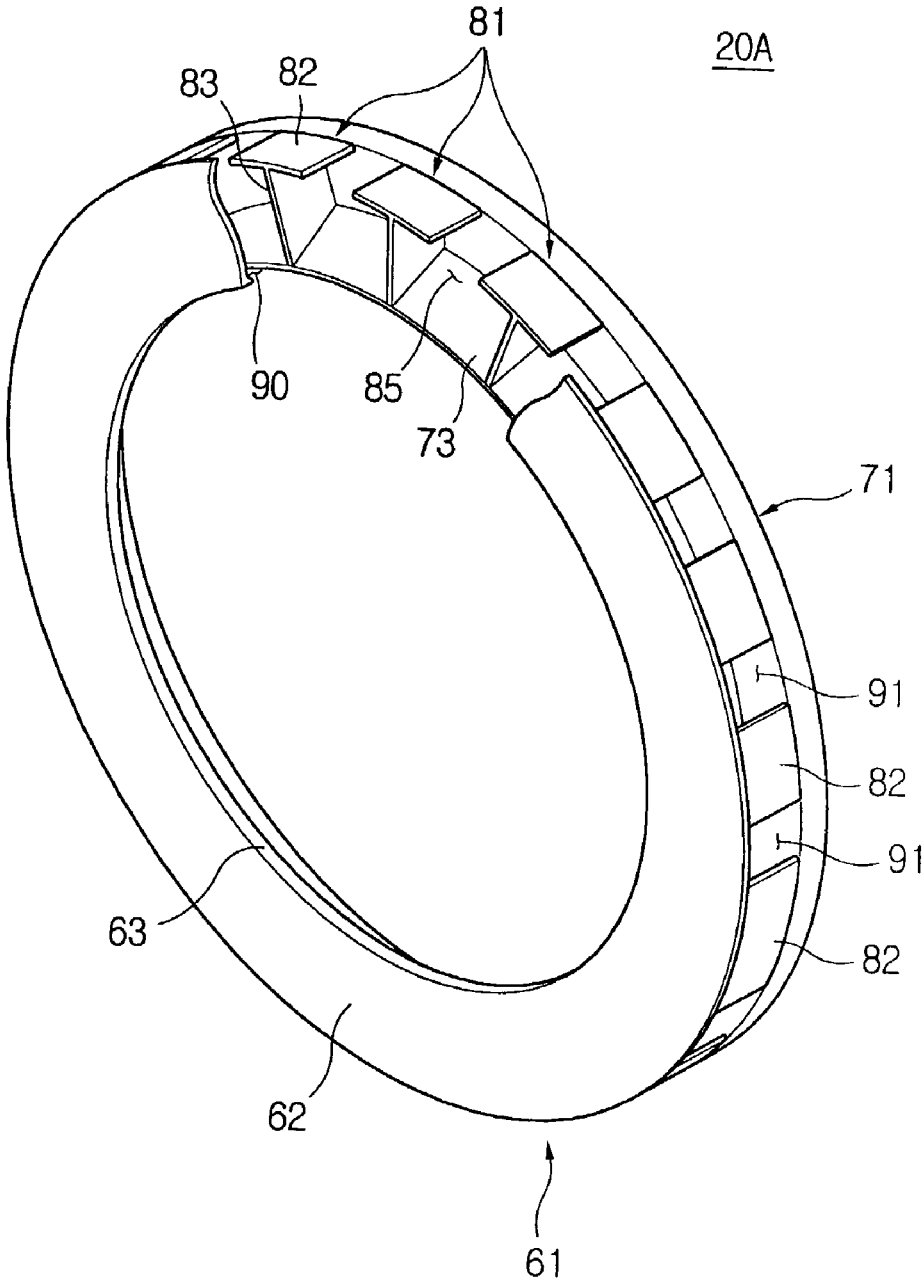
FIG. 7 is a partial cutaway perspective view of a water turbine according to another embodiment of the present invention.
Figure 8:
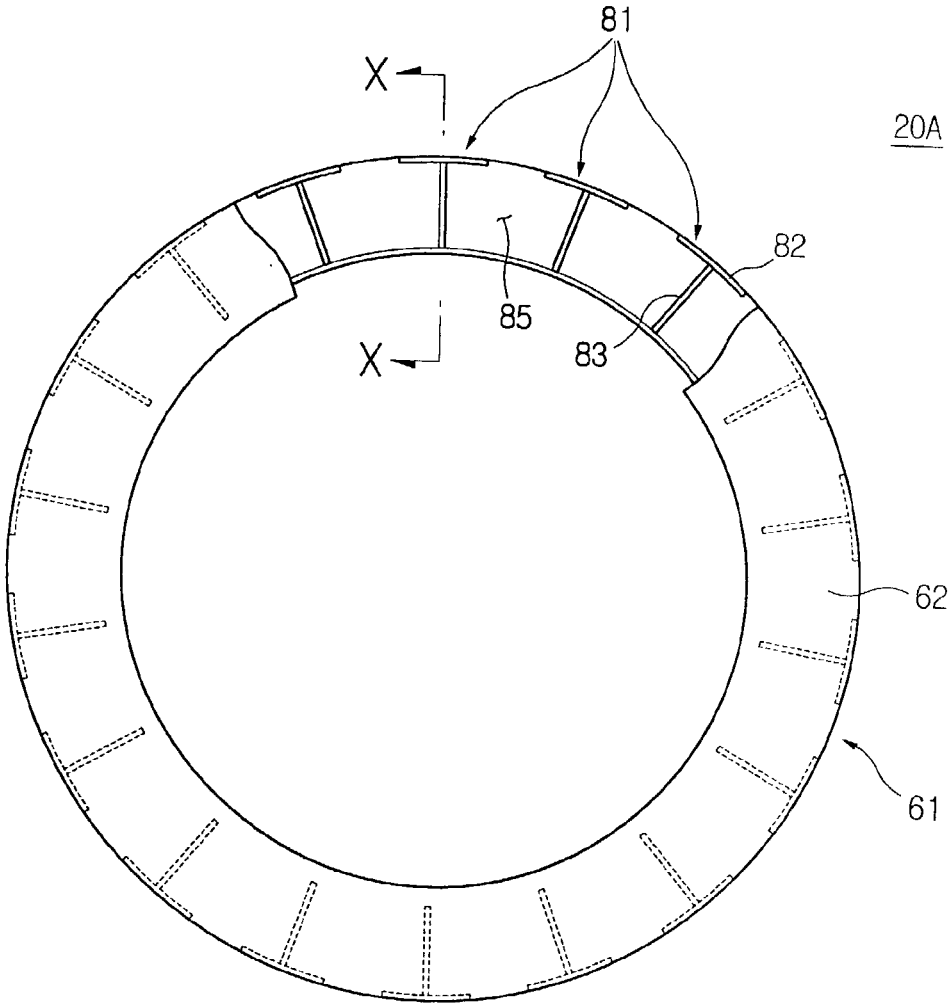
FIG. 8 is a partial cutaway right side view of the water turbine of FIG. 7.
Figure 9:
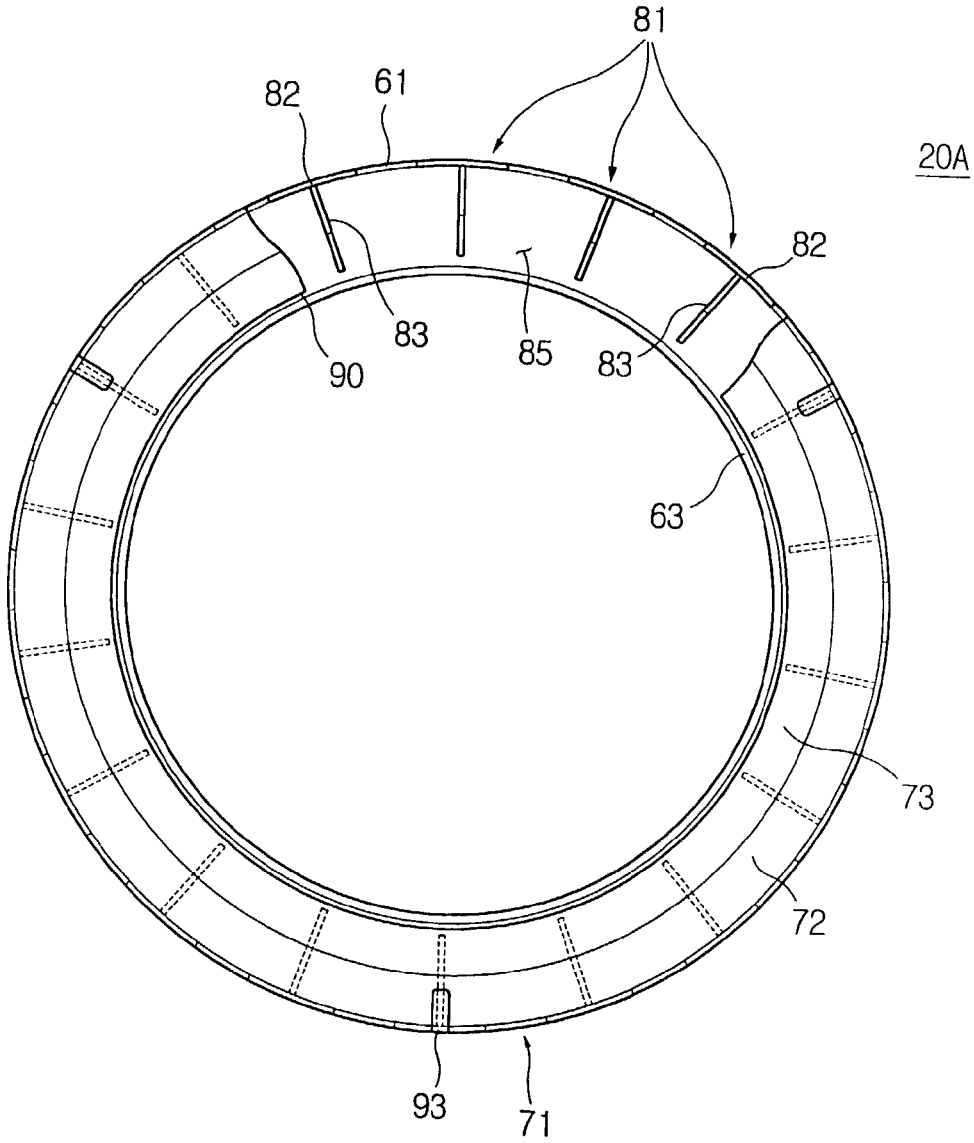
FIG. 9 is a partial cutaway left side view of the water turbine of FIG. 7.
Figure 10:
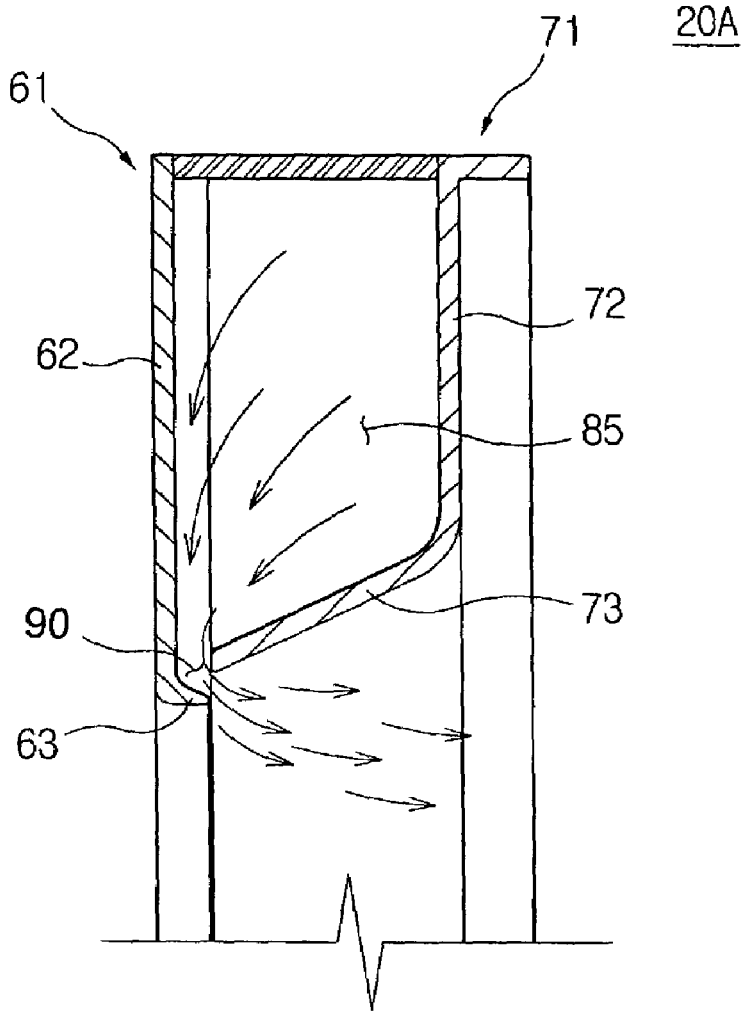
FIG. 10 is a sectional view taken along the line X—X of FIG. 8.

FIGS. 7 to 10 show a water turbine 20A according to another embodiment of the present invention. FIG. 7 is a partial cutaway perspective view of the water turbine 20A. FIGS. 8 and 9 are a partial cutaway right side view and a partial cutaway left side view of the water turbine 20A of FIG. 7, respectively. FIG. 10 is a sectional view taken along the line X—X of FIG. 8. As compared to the water turbine 20 of FIGS. 3–6, the water turbine 20A has an improved structure. That is, the water turbine 20A is capable of continuously raising and spraying the wash water by vane parts set in one chamber during an alternating directional rotation of the rotary tub 3.

As shown in FIG. 7, the water turbine 20A includes external and internal members 61 and 71 positioned so as to be opposite to each other, and a vane unit 81 set between the external and internal members 61 and 71.

The external and internal members 61 and 71, and the vane unit 81 have annular shapes. A plurality of wash water inlets 91 are formed between the outer circumferential edges of the external and internal members 61 and 71, so as to allow the wash water to flow into the vane unit 81 through the wash water inlets 91. An injection nozzle 90 is formed between the inner circumferential edges of the external and internal members 61 and 71, and sprays the wash water into the rotary tub 3.

As shown in FIG. 10, the internal member 71 includes a flat surface part 72 having a predetermined vertical length and an inclined surface part 73 which extends from the flat surface part 72 toward the inner circumferential edge of the external member 61. The external member 61 includes a flat surface part 62, and an injection guide part 63. In this case, the vertical length of the flat surface part 62 is almost equal to the vertical length obtained by adding the vertical length of the flat surface part 72 and the inclined surface part 73 of the internal member 71. The injection guide part 63 forms an end of the flat surface part 62. That is, the injection guide part 63 extends from the inner circumferential edge of external member 61 toward the inclined surface part 73 of the internal member 71.

The injection nozzle 90 of a predetermined width is formed between the inner circumferential edges of the external and internal members 61 and 71. The wash water passing through the injection nozzle 90 flows into the rotary tub 3 containing the laundry therein under the guide of the injection guide part 63 of the external member 61 (see arrows in FIG. 2).

As shown in FIGS. 7 to 9, the vane unit 81 is set between the external and internal members 61 and 71, and includes guide plates 82 and vanes 83. In this case, the guide plates 82 are formed by connecting the outer circumferential edges of the external and internal members 61 and 71 to each other. Each of the vanes 83 is designed so as to have one edge attached along both the flat surface part 72 and the inclined surface part 73 of the internal member 71, and the other edge attached along an internal surface of the flat surface part 62 of the external member 61.

Therefore, a chamber 85 is formed between the external and internal members 61 and 71, and the wash water inlets 91 are formed between the guide plates 82 arranged at regular intervals. Accordingly, the wash water flows into the chamber 85 through the wash water inlets 91. Such a construction allows the wash water to be sprayed into the rotary tub 3 in a clockwise or a counterclockwise direction by the guide plates 82 and the vanes 83 of the vane unit 81, as the rotary tub 3 is rotated in the clockwise or the counterclockwise direction. In this case, the vanes 83 perpendicularly extend from the guide plates 82 while being radially arranged in the water turbine 20A.

As shown in FIG. 9, screw holes 93 may be formed to receive screws (not shown) and mount the water turbine 20A to the open front of the rotary tub 3. The screw holes 93 are formed along the outer circumference of the internal member 71 at regular intervals. The external and internal members 61 and 71 may be attached to the guide plates 82 and the vanes 83 of the vane unit 81 using an adhesive. Alternatively, they may be screwed to the guide plates 82 and the vanes 83 of the vane unit 81.

Where the above water turbine 20A is rotated in the counterclockwise direction along with the rotary tub 3, the wash water flows into the chamber 85 through the wash water inlets 91 formed between the guide plates 82. After the wash water flows into the chamber 85 by the guide plates 82, the vanes 83, and the external and internal members 61 and 71, the wash water rapidly flows along the inclined surface part 73 of the internal member 71 and passes through the injection nozzle 90. Therefore, the wash water is sprayed into the rotary tub 3 under the guide of the injection guide part 63 of the external member 61. The injected wash water beats the laundry while wetting the laundry. In response to rotating of the rotary tub 3 in the counterclockwise direction, the wash water continuously passes through the injection nozzle 90 by the vanes 83 and continuously generates annular water currents, thus rapidly wetting the laundry as well as washing the laundry.

Where the water turbine 20A is rotated in the clockwise direction along with the rotary tub 3, the vanes 83 of the vane unit 81, which are radially arranged in the water turbine 20A and extend from the outer circumferences of the external and internal members 61 and 71 to the inner circumferences thereof, still raise the wash water in the water tub 2 to spray into the rotary tub 3. That is, an operation of the water turbine 20A in the clockwise direction is the same as the operation of the water turbine 20A in the counterclockwise direction. Accordingly, the operation of the water turbine 20A during the clockwise rotation of the rotary tub 3 will not be described in detail herein.

The water turbine 20A includes the chamber 85 having the vane unit 81 so as to continuously raise the wash water regardless of the rotating directions of the water turbine 20A. That is, whether the rotary tub 3 is rotated in the clockwise or the counterclockwise direction, the water turbine 20A raises the wash water through the chamber 85 and sprays the wash water into the rotary tub 3. The water turbine 20A is also simple in its structure.

Figure 11:
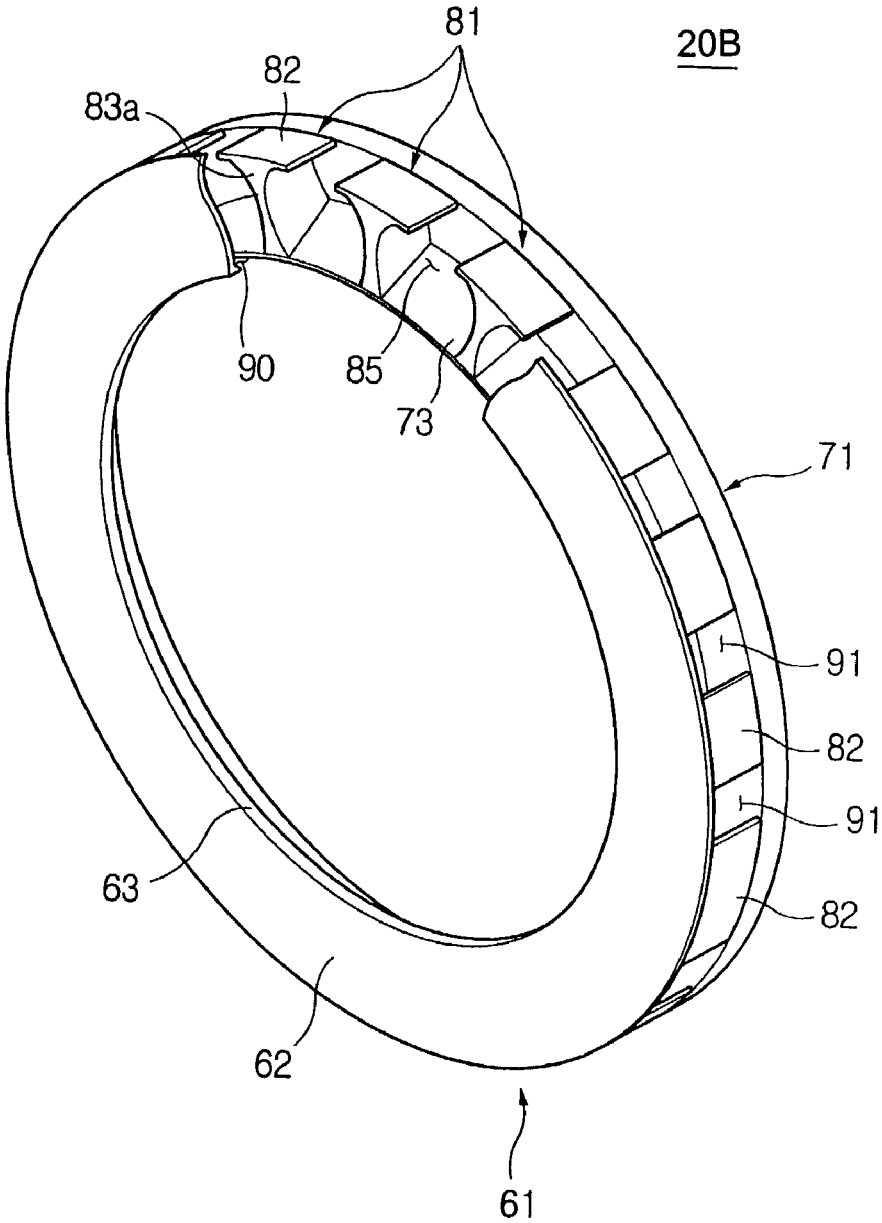
FIG. 11 is a partial cutaway perspective view of a water turbine according to yet another embodiment of the present invention where vanes each have concave side surfaces.

FIG. 11 shows a water turbine 20B according to yet another embodiment of the present invention. The structure of the water turbine 20B is the same as the water turbine 20A of FIGS. 7–10 except for vanes 83*a*. The vanes 83*a* extend from guide plates 82 while being radially arranged in the water turbine 20B. Each of the vanes 83 of the water turbine 20A includes side surfaces which are flat, as shown in FIGS. 7–10. In contrast, each of the vanes 83*a* of the water turbine 20B includes both side surfaces which are concave. The vanes 83*a* extend perpendicularly from the corresponding guide plates 82.

Such a construction allows the vanes 83*a* to more effectively raise and spray the wash water than that of the vanes 83 of the water turbine 20A. The remaining operational effect of the vanes 83*a*, for example, during a clockwise or a counterclockwise rotation of the rotary tub 3, is the same the vanes 83. Accordingly, a detailed description and operability of the vanes 83*a* will not described herein.

As described above, the present invention provides a drum type washing machine having a water turbine arranged at one surface of a rotary tub. The water turbine raises wash water with detergent contained in a water tub and sprays the mixture on laundry as the water turbine is rotated along with the rotary tub. Therefore, the detergent is rapidly dissolved in the wash water without an additional drive device. In addition, a wash time is shortened and the washing effect is improved.

Furthermore, the drum type washing machine of the present invention has less noise and vibration than that of a conventional drum type washing machine having a circulation pump and a circulation hose. Accordingly, performance is improved, and the manufacturing cost of the washing machines is reduced. Therefore, the present drum type washing machine has a market advantage over the conventional drum type washing machines.

In is understood that the present invention is not limited to a drum type washing machine having a water turbine. Rather, the water turbine of the present invention can be incorporated into other types of washing machines. Furthermore, a turbine structure of the present invention and the benefit of such a structure can be applied to other appliances. For example, a turbine structure of the present invention can be incorporated into a laundry dryer, so as to channel, accelerate and circulate air in the laundry dryer to more effectively dry laundry therein.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A drum type washing machine comprising:

a cabinet which defines an outer appearance of the washing machine;

a water tub set inside the cabinet to contain wash water therein;

a rotary tub rotatably set in the water tub and includes spin-drying perforations; and a water turbine which is mounted at a surface of the rotary tub, rotates along with the rotary tub and sprays the wash water contained in the water tub into the rotary tub, wherein a rotational axis of the rotary tub is approximately horizontal, and the water turbine comprises an external member, an internal member, and a vane unit arranged between the external and internal members, such that the vane unit channels and sprays the wash water into the rotary tub.

2. The drum type washing machine according to claim 1, wherein the water turbine generates forced water currents and sprays the forced water currents into the rotary tub to increase a washing effect.

3. The drum type washing machine according to claim 2, wherein:

the wash water includes detergent, and the forced wash water currents generated by the water turbine dissolve the detergent.

4. The drum type washing machine according to claim 1 further comprising:

a water supply hose which supplies the wash water to the drum type washing machine;

a detergent container to contain detergent therein;

a drain hose to drains the wash water of the drum type washing machine;

a drain pump which discharges the wash water through the drain hose;

lifters which are arranged on an internal surface of the rotary tub, wherein the lifters move laundry contained in the rotary tub upward and drop the laundry from a top to a bottom inside of the rotary tub; and a drive motor which rotates the rotary tub.

5. The drum type washing machine according to claim 4, wherein the water turbine is rotated along with the rotary tub without an additional pump which provides a drive force to circulate the wash water.

6. A drum type washing machine comprising:

a cabinet which defines an outer appearance of the washing machine;

a water tub set inside the cabinet to contain wash water therein;

a rotary tub rotatably set in the water tub and includes spin-drying perforations; and a water turbine which is mounted at a surface of the rotary tub, rotates along with the rotary tub, and sprays the wash water contained in the water tub into the rotary tub, wherein the water turbine comprises;

an external member having an annular shape, an internal member having an annular shape corresponding to the external member, and arranged apart from the external member by an interval, and a vane unit which is set between the external and the internal members, and raises the wash water contained in the water tub and sprays the wash water into the rotary tub.

7. The drum type washing machine according to claim 6, wherein the vane unit comprises:

a partition plate which is positioned between the external and internal members, and forms external and internal chambers;

internal vanes provided on a first surface of the partition plate at first predetermined intervals; and external vanes provided on a second surface of the partition plate at second predetermined intervals, wherein the external and internal vanes are curved in opposite directions so as to raise the wash water regardless of a rotating direction of the rotary tub.

8. The drum type washing machine according to claim 7, wherein:

the internal member includes a flat surface part having a set length and an inclined surface part which extends from the flat surface part toward an inner circumferential edge of the external member, the partition plate includes a flat surface part and an inclined surface part which correspond to the flat surface part and the inclined surface part of the internal member, and the inclined surface part of the internal member and the inner circumferential edge of the external member form an injection nozzle therebetween having a set width, wherein an end portion of the inclined surface part of the partition plate is placed adjacent to the injection nozzle.

9. The drum type washing machine according to claim 8, wherein:

each of the internal vanes set in the internal chamber comprises:

a guide part which connects an outer circumferential edge of the internal member to an outer circumferential edge of the partition plate; and a vane part which extends from an end of the guide part and is mounted at the inclined surface part of the internal member so as to be curved in a direction, wherein internal wash water inlets are formed between the guide parts of the internal vanes, and each of the external vanes set in the external chamber comprises:

an external guide part which connects an outer circumferential edge of the external member to the outer circumferential edge of the partition plate; and an external vane part which extends from an end of the external guide part and is mounted at the inclined surface part of the partition plate so as to be curved in the opposite direction with respect to the vane part of each of the internal vanes, wherein external wash water inlets are formed between the external guide parts of the external vanes.

10. The drum type washing machine according to claim 9, wherein the internal and external wash water inlets channel the wash water into the corresponding internal and external chambers.

11. The drum type washing machine according to claim 8, wherein the external member includes an injection guide part which extends from the inner circumferential edge of the external member toward the inclined surface part of the internal member by a predetermined length, and guides the wash water passing through the injection nozzle into the rotary tub.

12. The drum type washing machine according to claim 11, wherein in response to the rotary tub being rotated in one direction, the wash water flows to the external chamber through the external wash water inlets, moves along the external vane parts of the external vanes with guide of the partition plate and the external member, and accelerates through the injection nozzle with guide of the injection guide part.

13. The drum type washing machine according to claim 12, wherein in response to the rotary tub being rotated in the other direction, the wash water flows to the internal chamber through the internal wash water inlets, moves along the vane parts of the vanes with guide of the partition plate and the internal member, and accelerated through the injection nozzle with guide of the injection guide part.

14. The drum type washing machine according to claim 6, wherein:

the internal member includes:

a flat surface part having a set length; and an inclined surface part which extends from the flat surface part toward an inner circumferential edge of the external member, and the inclined surface part of the internal member and the inner circumferential edge of the external member form an injection nozzle therebetween having a set width.

15. The drum type washing machine according to claim 14, wherein the vane unit comprises:

guide plates which connect corresponding outer circumferential edges of the external and internal members, wherein wash water inlets are formed between the guide plates arranged in predetermined intervals; and vanes which inwardly extend from the corresponding guide plates, wherein a first edge of each of the vanes is connected to the flat surface part and the inclined surface part of the internal member, and a second edge of each of the vanes is connected to an internal surface of the external member.

16. The drum type washing machine according to claim 15, wherein the external member includes an injection guide part which extends from the inner circumferential edge of the external member toward the inclined surface part of the internal member by a predetermined length, and guides the wash water passing through the injection nozzle into the rotary tub.

17. The drum type washing machine according to claim 16, wherein:

the flat surface part and the inclined surface part of the internal member, and the Internal surface of the external member form a chamber, and in response to rotation of the rotary tub, the wash water flows to the chamber through the wash water inlets, moves along the vanes and the inclined surface part with guide of the external and internal members, and accelerates through the injection nozzle with guide of the injection guide plate.

18. The drum type washing machine according to claim 15, wherein the vanes extend from the corresponding guide plates, are radially arranged in the water turbine, and both side surfaces of each of the vanes are flat.

19. The drum type washing machine according to claim 15, wherein the vanes extend from the corresponding guide plates, are radially arranged in the water turbine, and both side surfaces of each of the vanes are concave.

20. The drum type washing machine according to claim 15, wherein:

the flat surface part and the inclined surface part of the internal member, and the internal surface of the external member form a chamber, and the wash water inlets channel the wash water into the chamber.

21. A washing machine comprising:

a cabinet which defines an outer appearance of the washing machine;

a water tub set inside the cabinet to contain wash water therein;

a rotary tub rotatably set in the water tub; and a water turbine which is positioned at a mouth of the rotary tub, rotates along with the rotary tub, and comprises an external member, an internal member, and a vane unit arranged between the external and internal members, such that the vane unit sprays the wash water contained in the water tub into the rotary tub.

22. The washing machine according to claim 21, wherein the water turbine channels and accelerates the wash water, and sprays the accelerated wash water into the rotary tub.

23. The washing machine according to claim 21, wherein the water turbine is rotated along with the rotary tub, and channels, accelerates and sprays the wash water without an additional pump which provides a drive force to circulate the wash water.

24. A turbine for a washing machine having a cabinet which defines an outer appearance of the washing machine, a water tub set inside the cabinet to contain wash water therein, and a rotary tub rotatably set in the water tub, comprising:

an external member;

an internal member; and a vane unit arranged between the external and internal members, wherein:

the vane unit channels the wash water contained in the water tub and accelerates the wash water, and the turbine rotates along with the rotary tub and sprays the accelerated wash water into the rotary tub.

25. The turbine according to claim 24, wherein the water turbine channels, accelerates and sprays the wash water without an additional pump which provides a drive force to circulate the wash water.

26. A turbine for a laundry dryer having a cabinet which defines an outer appearance of the laundry dryer and a rotary tub rotatably set in the laundry dryer, comprising:

an external member;

an internal member; and a vane unit arranged between the external and internal members, wherein:

the vane unit channels air contained in the rotary tub and accelerates the air, and the turbine rotates along with the rotary tub and circulates the accelerated air into the rotary tub.

27. The turbine according to claim 26, wherein the turbine generates forced air currents and injects the forced air currents into the rotary tub to increase a drying effect.

* * * * *

UNITED STATES PATENT AND TRADEMARK OFFICE

CERTIFICATE OF CORRECTION

PATENT NO. : 7,010,942 B2
APPLICATION NO. : 10/223613
DATED : March 14, 2006
INVENTOR(S) : Doo-Young Ryu et al.

It is certified that error appears in the above-identified patent and that said Letters Patent is hereby corrected as shown below:

On Title Page Item (56)
Col. 2 (U.S. Patent Documents), Line 1, delete “Emil” and insert --Birr-- therefor.
Col. 2 (Other Publications), Line 1, delete “Europena” and insert --European-- therefor. - Title Page
Col. 10, Line 43, after “claim 1” insert --,--.
Col. 11, Line 5, delete “comprises;” and insert --comprises:-- therefor.
Col. 12, Line 60, delete “Internal” and insert --internal-- therefor.

Signed and Sealed this

Nineteenth Day of September, 2006

JON W. DUDAS
*Director of the United States Patent and Trademark Office*